US006243053B1

(12) United States Patent
Shtarkman

(10) Patent No.: US 6,243,053 B1
(45) Date of Patent: Jun. 5, 2001

(54) DEPLOYABLE LARGE ANTENNA REFLECTOR STRUCTURE

(75) Inventor: Emil M. Shtarkman, Marina Del Rey, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/261,888

(22) Filed: Mar. 2, 1999

(51) Int. Cl.[7] ..... H01Q 15/20

(52) U.S. Cl. ..... 343/915; 343/880; 343/882; 343/912; 52/111

(58) Field of Search ..... 343/881, 915, 343/912, 878, 880, 882; 52/111, 646; H01Q 15/20

(56) References Cited

U.S. PATENT DOCUMENTS

| | | | | |
|---|---|---|---|---|
| 4,475,323 | | 10/1984 | Schwartzberg et al. | 52/111 |
| 4,578,920 | | 4/1986 | Bush et al. | 52/645 |
| 4,819,399 | | 4/1989 | Onoda | 52/646 |
| 4,845,511 | * | 7/1989 | Grayson et al. | 343/915 |
| 5,104,211 | * | 4/1992 | Schumacher et al. | 343/915 |
| 5,864,324 | * | 1/1999 | Acker et al. | 343/915 |
| 5,990,851 | * | 11/1999 | Henderson et al. | 343/915 |
| 6,028,570 | * | 2/2000 | Gelger et al. | 343/915 |

* cited by examiner

*Primary Examiner*—Tho G Phan
(74) *Attorney, Agent, or Firm*—Robert W. Keller

(57) ABSTRACT

A deployable antenna reflector structure (10) that provides a reduced number of components without compromising mechanical stability or deployment reliability. The structure (10) uses a truss hoop (21) with identical elements (20) and parallel pivot axes (30) to transition from a stowed position (50) to a deployed position (51). The use of identical elements (20) provides reduced manufacturing and assembly costs due to the reduction in components and added simplicity of the design. The truss hoop (21) achieves mechanical stability by making use of a two-dimensional element design having vertical portions (23) and horizontal portions (22) located in the same plane. Each parallel pivot axis (30) is defined by two pivot points. The first pivot point (31) connects horizontal portions (22) of adjacent identical elements (20) and the second pivot point (31) connects vertical portions (23) of adjacent identical elements (20). The structure (10) also provides a reflector (40) and a deployment control mechanism. The reflector (40) guides antenna signals when the structure (10) is in the deployed position (51). The deployment control mechanism determines when the parallel pivot axes (30) transition the structure from the stowed position (50) to the deployed position (51).

13 Claims, 2 Drawing Sheets

DEPLOYABLE LARGE ANTENNA REFLECTOR STRUCTURE

BACKGROUND OF THE INVENTION

1. Field of the Invention

The present invention relates generally to deployable antenna reflector structures. More particularly, the present invention relates to an improved antenna reflector structure that provides a reduced number of components without compromising mechanical stability or deployment reliability.

2. Discussion of the Related Art

In the field of space exploration, large structures must often be foldable in order to fit into launch vehicles having limited cargo capacity. Once in space, these structures must deploy to a size sufficiently large to justify the cost of launching them. A typical such structure is a large aperture antenna reflector. Current deployable antenna reflector structures are quite complex with large numbers of truss elements having varying sizes and varying designs. For example, antenna reflector deployment typically requires the pivoting of truss elements around multiple axes that point in multiple directions. This complexity causes the manufacture of a single antenna reflector to be very costly due to time consuming assembly and high component costs. Current antenna reflector structures are also not very adaptable to multiple applications.

A substantial reason for such complicated antenna reflector designs has been the need to achieve a sufficient level of mechanical stability as well as deployment reliability. Mechanical stability has typically been achieved through box truss hoops or multiple triangular configurations—both requiring three-dimensional element designs with multiple components. Deployment reliability has been achieved through complex synchronization mechanisms or solenoid operated latch arrangements—both requiring additional weight and cost. Deployment reliability also depends on the method of mesh stowing and deployment.

The large number of components also causes current antenna reflector structures to be extremely heavy, which reduces the launch vehicle cargo capacity and reduces the stowed natural frequency. The stowed natural frequency is significant because launch vibrations matching the natural frequency or one of its harmonics may cause substantial damage to the antenna reflector. Thus, there is a need to combat the problem created by complex antenna reflector structure designs without compromising mechanical stability or deployment reliability.

SUMMARY OF THE INVENTION

The deployable antenna reflector structure of the present invention uses a truss hoop with identical elements and parallel pivot axes to transition from a stowed position to a deployed position. The use of identical elements provides reduced manufacturing costs due to the reduction in components and the added simplicity of the design. The truss hoop achieves mechanical stability by making use of a two-dimensional element design having vertical portions and horizontal portions located in the same plane. An example of such a design is a S-shape. With adjacent identical elements facing in opposite directions, the parallel pivot axes connect the identical elements to create a structurally sound truss hoop.

The parallel pivot axes also add to simplicity without compromising mechanical stability. Each parallel pivot axis is defined by two pivot points. The first pivot point connects the horizontal portions of the identical elements and the second pivot point connects the vertical portions of the identical elements. The use of pivot points along parallel axes allows the truss hoop to maintain stiffness in spite of the two-dimensional design of the identical elements. The square of angular frequency for a truss hoop equals stiffness divided by mass. The design therefore provides a high natural frequency for the truss hoop due to an increased stiffness and decreased mass. The first pivot point provides potential energy when the structure is in the stowed position, and the second pivot point is a unidirectional joint that prevents the structure from transitioning out of the deployed position once deployed. Therefore, each pivot point serves a distinct purpose while maintaining structural simplicity.

The deployable antenna reflector structure also includes a reflector and a deployment control mechanism. The reflector guides antenna signals either to or from an antenna feed when the structure is in the deployed position. Compartmentalizing the reflector between the identical elements when the structure is in the stowed position improves deployment reliability and provides minimal stowing volume. The deployment control mechanism determines when the parallel pivot axes transition the structure from the stowed position to the deployed position.

Further objects, features and advantages of the invention will become apparent from a consideration of the following description and the appended claims when taken in connection with the accompanying drawings.

DETAILED DESCRIPTION OF THE PREFERRED EMBODIMENT

The following discussion directed to a deployable antenna reflector structure is mere exemplary in nature, and is in no way intended to limit the invention or its applications or uses.

Figure 1:
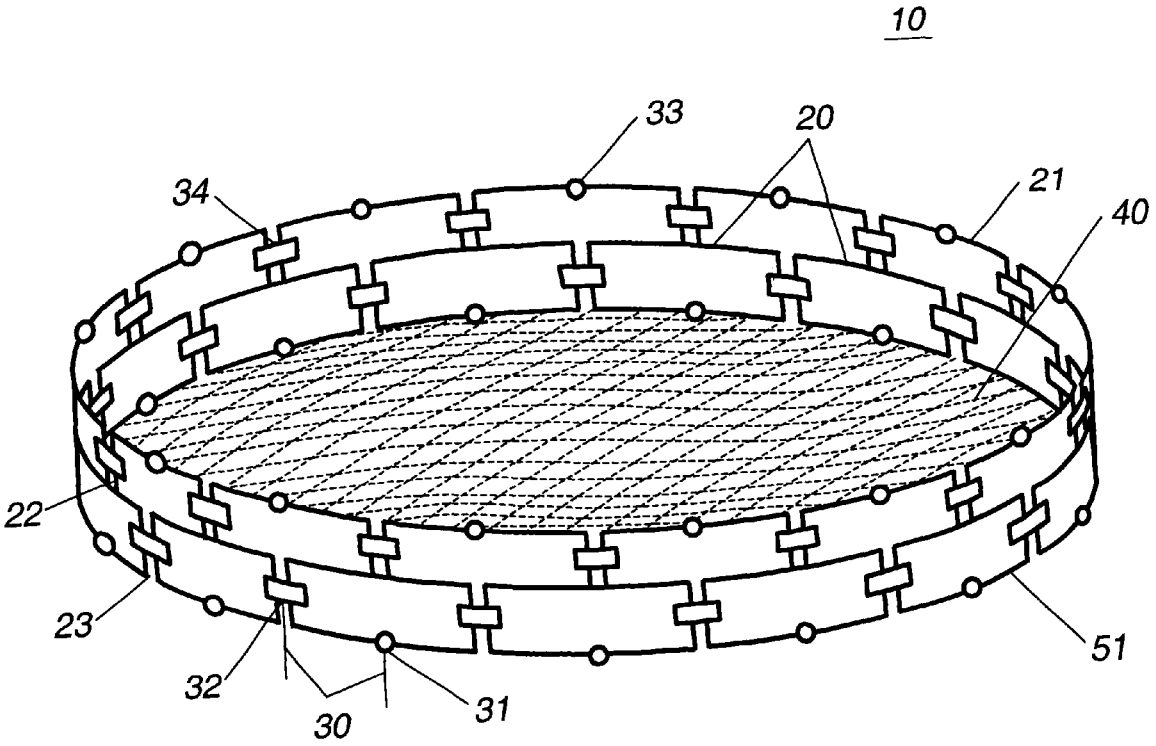
FIG. 1 is a perspective view of a deployable antenna reflector structure of the present invention in the deployed position.
Figure 2:
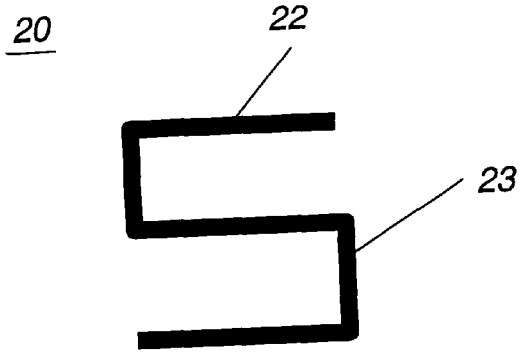
FIG. 2 is a side view of one of the S-shaped structural element of the antenna structure of FIG. 1.
Figure 3:
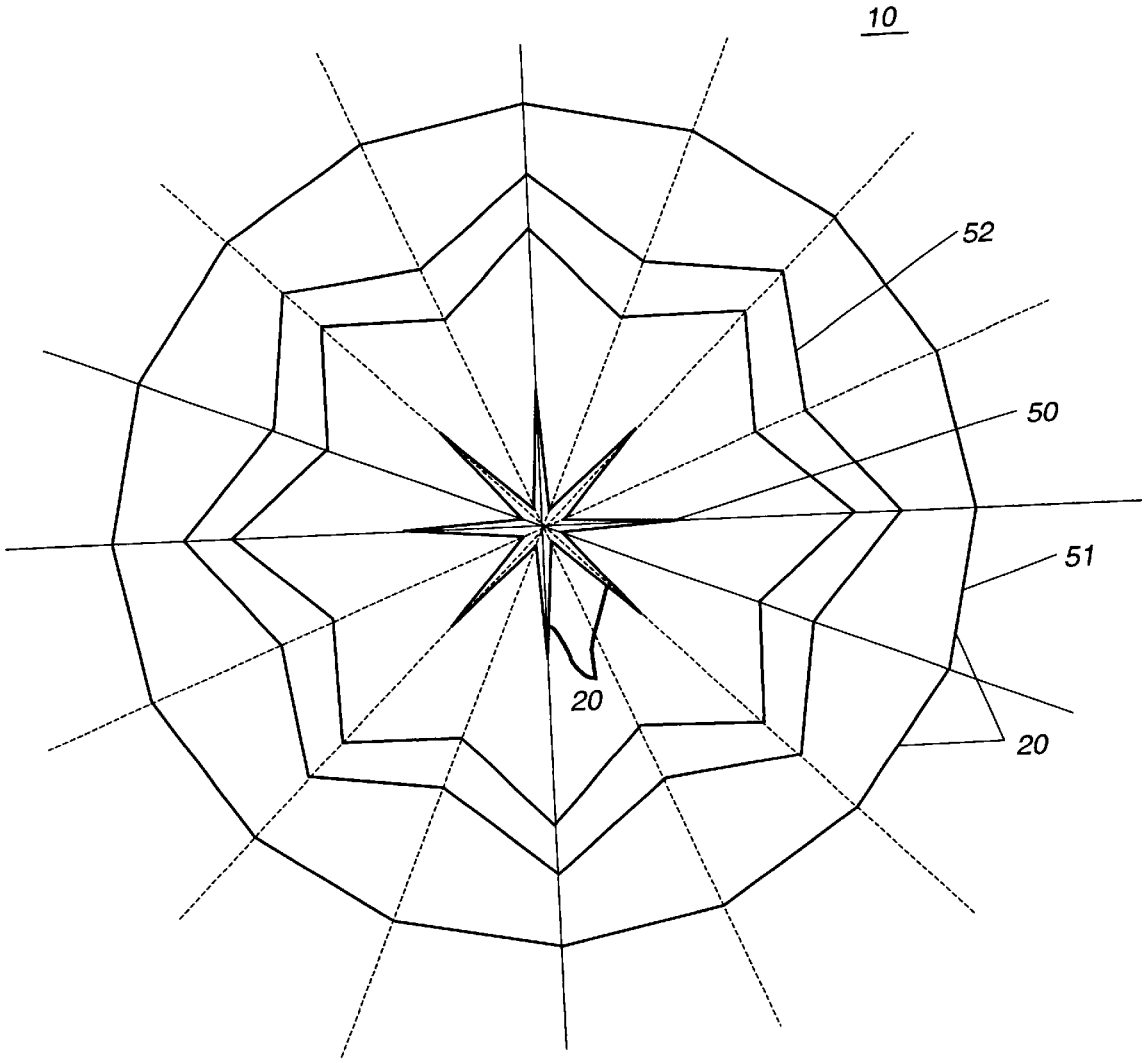
FIG. 3 is top view of a deployable antenna reflector structure showing the deployment sequence of the present invention.

Turning now to FIG. 1, a deployable antenna reflector structure, indicated generally at 10, according to the invention, includes a plurality of shaped elongated elements 20, a plurality of pivot axes 30, and a reflector 40. Each element 20 is identical and has an "S-shape" formed from an elongated tubular member or the like. Adjacent elements 20 are positioned in opposite orientations to each other so that the S-shapes oppose. FIG. 2 shows a side-view of one of the elements 20 separated from the structure 10. The pivot axes 30 are defined between each element 20. As best shown in FIG. 3, deployment involves transitioning the structure 10 from a stowed position 50 to a partially deployed position 52, and then to a fully deployed position 51. The plurality of elements 20 provide mechanical support to the structure 10. The plurality of parallel pivot axes 30 connect the plurality of elements 20 to create a truss hoop 21, and are capable of transitioning the structure 10 from the stowed position 50 to the deployed position 51. The reflector 40 is connected to the truss hoop 21 and guides antenna signals either to or from an antenna feed (not shown) when the structure 10 is in the deployed position 51. The present invention is intended to provide an improved construction of and technique for deploying antenna reflector structures, and is thus used with existing launch systems and antenna feed configurations.

The elements 20 provide mechanical benefits and require no additional support due to their S-shape with adjacent elements facing in opposite directions. Other shapes such as a Z-shape provide similar benefits. Each element 20 preferably is a hollow fiber-reinforced graphite composite tubular structure, having a horizontal dimension of approximately 3 meters, and a vertical dimension of approximately 5 meters. Since the elements 20 have the same shape, selection of the above dimensions allows a one hundred meter in diameter structure 10 to be constructed with as few as one hundred elements 20.

Each parallel pivot axis 30 is defined by a first pivot point 31 and a second pivot point 32. The first pivot point 31 connects horizontal portions 22 of the elements 20 and the second pivot point 32 connects vertical portions 23 of the identical elements 20. The first pivot point 31 preferably includes an element joint 33 and the second pivot point 32 preferably includes a flexible hinge 34. The flexible hinge 34 has a construction that provides potential energy when the structure 10 is in the stowed position 50. An example of such a construction can be found with conventional carpenter tape. The element joint 33 includes a unidirectional bearing that prevents the structure from transitioning out of the deployed position 51. The same purpose could be served by including a plurality of gears in the element joint 33.

The reflector 40 includes a wire mesh wherein the wire mesh is made of a gold-plated pretensed wire. Pretensing the wire mesh provides more reliable deployment of the structure 10. The wire mesh is compartmentalized between the plurality of elements 20 when the structure 10 is in the stowed position 50.

The structure 10 can also have a deployment control mechanism (not shown) for determining when the plurality of parallel pivot axes 30 transition the structure 10 from the stowed position 50 to the deployed position 51. The deployment control mechanism preferably includes a cable system which constrains the structure 10 in the stowed position 50 until the cable system is removed. The cable system can be driven by a DC electric motor or other suitable means.

In operation, the stowed volume of the structure 10 can be tailored for a given spacecraft configuration. In the stowed position 50, the reflector 40 is compartmentalized between the plurality of elements 20 to provide minimal volume. When the deployment control mechanism is triggered, the transition from the stowed position 50 to the deployed position begins and the reflector gradually retracts from the designed compartments. The varying stages of deployment are best shown in FIG. 3. The potential energy of the flexible hinges 34, which face in alternating directions, biases the structure 10 to the deployed position 51. The unidirectional bearings of the element joints 33 also face in alternating directions and ensure that the transition of the structure 10 is only outward. When the structure 10 reaches the deployed position 51, the deployment is complete. The truss hoop 21 can be easily adapted for other applications such as light weight storage tanks, bridges, platforms, and buildings.

It is to be understood that the invention is not limited to the exact construction illustrated and described above, but that various changes and modifications may be made without departing from the spirit and scope of the invention as defined in the following claims.

What is claimed is:

1. A deployable antenna reflector structure comprising:

a plurality of elements that provide mechanical support to said structure, said elements having an S-shape wherein adjacent elements face in opposite directions;

a plurality of parallel pivot axes connecting said plurality of elements to create a truss hoop, said plurality of parallel pivot axes capable of transitioning said structure from a stowed position to a deployed position; and a reflector for guiding antenna signals when said structure is in said deployed position, said reflector connected to said truss hoop.

2. The deployable antenna reflector structure according to claim 1 wherein each parallel pivot axis is defined by a first pivot point and a second pivot point, said first pivot point connecting horizontal portions of said elements and said second pivot point connecting vertical portions of said elements.

3. The deployable antenna reflector structure according to claim 2 wherein said first pivot point includes an element joint and said second pivot point includes a flexible hinge.

4. The deployable antenna reflector structure according to claim 3 wherein said flexible hinge includes carpenter tape, said carpenter tape having potential energy when said structure is in said stowed position.

5. The deployable antenna reflector structure according to claim 3 wherein said element joint includes a unidirectional bearing, said unidirectional bearing preventing said structure from transitioning from said deployed position to said stowed position.

6. The deployable antenna reflector structure according to claim 3 wherein said element joint includes a plurality of gears, said plurality of gears preventing said structure from transitioning from said deployed position to said stowed position.

7. The deployable antenna reflector structure according to claim 1 wherein said reflector includes a wire mesh.

8. The deployable antenna reflector structure according to claim 7 wherein said wire mesh is compartmentalized between said plurality of elements when said structure is in said stowed position.

9. A deployable antenna reflector structure comprising:

a plurality of identical elements that provide support to said structure, said identical elements having an S-shape and facing in opposite directions;

a plurality of parallel pivot axes connecting said plurality of identical elements to create a truss hoop, said plurality of parallel pivot axes capable of transitioning said structure from a stowed position to a deployed position, each parallel pivot axes defined by a first pivot point and a second pivot point, said first pivot point connecting horizontal portions of said identical elements and said second pivot point connecting vertical portions of said identical elements; and a reflector for guiding antenna signals when said structure is in said deployed position, said reflector connected to said truss hoop and including a wire mesh which is compartmentalized between said plurality of identical elements when said structure is in said stowed position.

10. The deployable antenna reflector structure according to claim 9 wherein said plurality of identical elements includes approximately 100 S-shaped elements, each said S-shaped element having a hollow fiber-reinforced graphite composite tubular structure, a horizontal dimension of approximately 3 meters, and a vertical dimension of approximately 5 meters.

11. The deployable antenna reflector structure according to claim 9 wherein said first pivot point includes a unidirectional bearing, said unidirectional bearing preventing said structure from transitioning from said deployed position to said stowed position, and said second pivot point includes carpenter tape, said carpenter tape having potential energy when said structure is in said stowed position.

12. The deployable antenna reflector structure according to claim 9 wherein said wire mesh includes gold-plated pretensed wire which is compartmentalized between said plurality of identical elements when said structure is in said stowed position.

13. A truss hoop comprising:

a plurality of identical elements that provide support to said truss hoop, said identical elements having an S-shape where adjacent elements face in opposite directions;

a plurality of parallel pivot axes connecting said plurality of identical elements, said plurality of parallel pivot axes capable of transitioning said truss hoop from a stowed position to a deployed position, each pivot axis defined by a first pivot point and a second pivot point, said first pivot point connecting horizontal portions of said identical elements and said second pivot point connecting vertical portions of said identical elements.

* * * * *